US011793298B2

(12) United States Patent
Pulfrey et al.

(10) Patent No.: US 11,793,298 B2
(45) Date of Patent: Oct. 24, 2023

(54) HAIR BRUSH

(71) Applicant: TANGLE TEEZER LIMITED, London (GB)

(72) Inventors: Shaun Pulfrey, London (GB); Cameron Bruce William Treeby, London (GB)

(73) Assignee: Tangle Teezer Limited

( * ) Notice: Subject to any disclaimer, the term of this patent is extended or adjusted under 35 U.S.C. 154(b) by 272 days.

(21) Appl. No.: 15/320,147

(22) PCT Filed: Jun. 30, 2015

(86) PCT No.: PCT/GB2015/051916
§ 371 (c)(1),
(2) Date: Dec. 19, 2016

(87) PCT Pub. No.: WO2016/001658
PCT Pub. Date: Jan. 7, 2016

(65) Prior Publication Data

US 2018/0228277 A1 Aug. 16, 2018

(30) Foreign Application Priority Data

Jun. 30, 2014 (GB) ..... 1411577
Jun. 30, 2014 (GB) ..... 1411583

(51) Int. Cl.
*A46B 9/02* (2006.01)
*A46D 1/00* (2006.01)

(52) U.S. Cl.
CPC ..... *A46B 9/023* (2013.01); *A46D 1/0238* (2013.01); *A46B 2200/104* (2013.01)

(58) Field of Classification Search
CPC .. A46B 9/023; A46B 2200/104; A46D 1/0238
(Continued)

(56) References Cited

U.S. PATENT DOCUMENTS 3,133,546 A 5/1964 Dent
3,797,506 A 3/1974 Reinsch
(Continued)

FOREIGN PATENT DOCUMENTS

DE 632357 2/1937
EP 3097817 A1 11/2016
(Continued)

OTHER PUBLICATIONS

Translation of JP-2013048781-A, retrieved from Espacenet on Feb. 25, 2021 (Year: 2013).*
(Continued)

*Primary Examiner* — Thomas Raymond Rodgers
(74) *Attorney, Agent, or Firm* — Watts Law LLC; John A. Yirga, Esq.

(57) ABSTRACT

A hair brush with an array of bristles (4). Each bristle extends from a base to a free end. Some or all of the bristles have relatively wide first portion, towards the base of the bristle, and a relatively narrow second portion, towards the free end of the bristle. The bristles are arranged in offset rows and centre lines of the rows are spaced apart such that at least part of the first portion of bristles in one row extends between adjacent bristles in an adjacent row and/or, when viewed perpendicular to the rows, the width of the first portion of the bristles in one row is, over part of their length, the same or greater than the space between adjacent bristles in an adjacent row so as to partially occlude the space between bristles in an adjacent row. The bristles are sized and arranged so that the first portion of the bristles serves to easily penetrate and divide hair between the bristles and the second portion of the bristles enables tension to be applied to the hair when hair flows between the bristles.

20 Claims, 6 Drawing Sheets

(58) Field of Classification Search
USPC ..... 15/160, 186, 187, 188
See application file for complete search history.

(56) References Cited

U.S. PATENT DOCUMENTS

| | | | | |
|---|---|---|---|---|
| 4,565,205 | A * | 1/1986 | Taylor | A45D 40/265 132/218 |
| 4,612,944 | A | 9/1986 | Bachrach et al. | |
| D315,428 | S * | 3/1991 | Davies | D28/30 |
| 5,771,904 | A * | 6/1998 | Lange | A46D 1/0284 132/159 |
| 5,915,436 | A * | 6/1999 | Johnson | A46B 3/005 15/187 |
| 6,732,398 | B2 * | 5/2004 | McConnell | A46D 1/00 15/167.1 |
| D593,710 | S * | 6/2009 | Wise | D28/21 |
| 8,056,568 | B2 * | 11/2011 | Ruckart | A45D 24/04 132/108 |
| 8,627,537 | B2 * | 1/2014 | Mercier | A46B 9/02 15/160 |
| 8,627,829 | B2 * | 1/2014 | Williams | A46B 9/06 132/110 |
| 2003/0009838 | A1 * | 1/2003 | Nakamura | A46D 1/00 15/207.2 |
| 2005/0015909 | A1 | 1/2005 | Spitale et al. | |
| 2008/0017217 | A1 * | 1/2008 | Leung | A45D 20/525 132/313 |
| 2009/0083925 | A1 * | 4/2009 | Mathiez | A46B 3/005 15/207.2 |
| 2011/0088188 | A1 | 4/2011 | Ghodsi | |
| 2012/0124764 | A1 * | 5/2012 | Watanabe | A46B 9/023 15/160 |
| 2016/0262518 | A1 * | 9/2016 | Guy-Rabi | A46B 3/005 |
| 2016/0338467 | A1 * | 11/2016 | Park | A46B 7/042 |

FOREIGN PATENT DOCUMENTS

| | | | |
|---|---|---|---|
| GB | 2447692 | A | 9/2008 |
| JP | 3076313 | B2 * | 8/2000 |
| JP | 2000350619 | A | 12/2000 |
| JP | 2003199621 | A | 7/2003 |
| JP | 2003199624 | A | 7/2003 |
| JP | 2003206217 | A | 7/2003 |
| JP | 2013048781 | A * | 3/2013 |
| SU | 912139 | A | 3/1982 |
| SU | 912139 | A1 * | 3/1982 |
| WO | WO2008/018965 | | 2/2008 |
| WO | WO2013/120445 | A1 | 8/2013 |
| WO | WO 2015/111138 | A1 | 7/2015 |
| WO | WO2016/001658 | A1 | 1/2016 |

OTHER PUBLICATIONS

Translation of JP3076313B2 retrieved from Google patents on Mar. 21, 2022 (Year: 2000).*
International Search Report from PCT Application No. PCT/GB2015/051916, Publication No. WO 2016/001658 (2 pages).
Combined Search and Examination Report for Patent Application No. GB1617364.3 dated Mar. 21, 2017; 7 pages.

* cited by examiner

HAIR BRUSH

CROSS REFERENCES TO RELATED APPLICATION

The present application is a 35 U.S.C. § 371 National Stage Patent Application claiming priority to International PCT Application Serial No. PCT/GB2015/051916 having an international filing date of Jun. 30, 2015, and that was published on Jan. 7, 2016, under International Publication Number WO 2016/001658, which claims priority to Great Britain Patent Application Serial Nos. 1411577.8 that was filed on Jun. 30, 3014, and 1411583.6 that was filed on Jun. 30, 2014. All of the above-identified applications and publication from which priority is claimed are incorporated herein by reference in their entireties for all purposes.

TECHNICAL FIELD OF THE INVENTION

The present invention relates to a hair brush for styling hair.

BACKGROUND TO THE INVENTION

When styling hair professional hairdressers routinely apply varying amounts of tension to the hair while heating with a hair dryer. This enables the hair to straightened and then shaped and set with heat into a desired style.

Tension is applied with a hair brush. For shorter hair a round brush is used. Hair is wrapped onto the brush so that it is gripped by the bristles of the brush to enable tension to be applied to the hair as it slides through the bristles of the brush. The more quickly the brush is moved through the hair the greater the tension applied to the hair. For longer hair a round brush with greater diameter, or a paddle brush, is used.

However, problems can arise when using this technique which can make it difficult for amateurs to employ, and for anyone styling their own hair. Bristles of a hairbrush need to be dense so as to grip the hair and enable tension to be applied. It can be difficult to pick up the hair and direct it down into these bristles. Also, once hair is flowing through the bristles it often binds, leading to pulling of the hair which causes discomfort, stretched hair and hair loss. When tangles are present in hair, a hair brush used to apply tension to the hair will readily snag on the tangles.

Another hair styling technique is back combing. With this technique hair is held under tension extending away from a person's scalp, and then gradually brushed back towards the scalp. This approach teases a few strands of hair at a time out of the stylist's grip and back towards the scalp, introducing tangles into the hair so as to build body. Following this step, the outer layer of the body of back combed hair is gently brushed to remove tangles and provide an attractive external appearance.

As with heating hair under tension, this technique also requires using a brush which is able to grip the hair and so similar difficulties can be encountered. It also requires a second brush or comb for smoothing the outer layer following back combing.

Embodiments of the present invention have been made in consideration of these issues.

SUMMARY OF THE INVENTION

According to an aspect of the present invention there is provided a hair brush for styling hair, the brush comprising: an array of bristles each extending from a base to a free end;

at least some or all of the bristles comprising a first, relatively wide, portion which tapers from the base and a second, relatively narrow, portion which extends from the first portion to the free end; the bristles being arranged in two or more spaced apart, offset, rows wherein centre lines of the rows are spaced apart such that at least part of the first portion of bristles in one row extends between adjacent bristles in an adjacent row; and/or, when viewed perpendicular to the rows, the width of the first portion of the bristles in one row is, over part of their length, the same or greater than the space between adjacent bristles in an adjacent row so as to partially occlude the space between bristles in an adjacent row; and the bristles are sized and arranged so that, in use, the first portion serves to penetrate and divide hair between the bristles and the second portion of the bristles enables tension to be applied to the hair when hair flows between the bristles.

The first portion of the bristles helps to easily divide the hair, as well as helping remove tangles. It is also useful in smoothing the outer layer of back combed hair. By virtue of their greater width, and the arrangement of the bristles, the space between the second portions of the bristles is less than between the first portions. Consequently, as hair flows between the second portions of the bristles there is greater friction between the bristles and hair, enabling tension to be applied to the hair.

The first and/or second portion of the bristles may be flexible and may be resiliently flexible. The second portion of the bristles may be more flexible than the first.

The first portion of the bristles may have a larger transverse cross-sectional area then the second portion.

All, or a substantial proportion (such as at least half), of the bristles in the array, or of the brush, may be provided with first and second portions. All of these, or indeed all or substantially all the bristles in the array, or the brush, may be of substantially the same shape.

When viewed in the same direction, the width of the widest part of the first portion of the bristles having first and second portions may be at least twice, three or four times the width of any part of the second portion or the second portion at or near to its free end. When viewed in the same direction, the width of the widest part of the first portion of the bristles having first and second portions may be no more than twelve or fifteen times the width of the bristle at any part of the second portion or at or near its free end. The length of the bristles having first and second portions may be no greater than seven, nine or ten times its maximum width. The length of the bristles having first and second portions may be no less than twice their maximum width.

In some preferred embodiments the ratio of width of the base of the bristle to that at or near its tip, or any part of the second portion, varies in the range four to ten, with a ratio of about six being particularly useful. The ratio of overall length to maximum width of the bristles may vary from 2 to 5 with a ratio of about 3 being particularly useful.

The various ranges mentioned above have been found to provide a satisfactory balance between the performance of the first and second portions of the bristles.

The width of the bristles may vary continuously or discontinuously between their base and free ends. Along part of its length, and preferably within the first portion of the bristles, the width of the bristles may taper at an angle greater than the angle of taper of a uniformly tapered bristle having the same length and variation in width. This allows there to be significantly more space between the second portion of the bristles in the array than the first portion, as compared to uniformly tapered bristles. This enables the two portions of the bristles to perform their different functions without being unduly long.

Two opposed edges of the first portion of those bristles comprising first and second portions may taper towards each other with a minimum average angle of at least 10 degrees between the opposed edges over the length of the first portion, and opposite sides of the second portion may taper towards each other with a maximum average angle of 5 degrees between opposed edges over the length of the second portion. Two opposed edges of the first portion may taper towards each other with a minimum average angle of at least 15 or 18 degrees.

The angle between the opposed edges of the first portion may increase from the base of the bristle to the end of the first portion. The opposed edges of the first portion may be curved.

All opposed edges of the first portion may taper towards each other with a minimum average angle of at least 5 degrees between the opposed edges over the length of the first portion.

The degree of taper of the bristles may change abruptly at the interface between the first and second portions of the bristles.

These features provide for a bristle with a wider first portion which tapers relatively abruptly over its length or a small proportion of its length to a second portion which has only a gradual taper.

The first portion may have a non-circular transverse cross-section over at least part or substantially all of its length. The cross-section may be elongate in shape and may be substantially oval. The first portion may have a non circular cross-section at its base which gradually transitions to a substantially circular cross-section at the point where it meets the second section. The first portion of those bristles with first and second portions may terminate where the second portion begins. The bristles may consist only of the first and second portions.

Where at least part of the first portion has an oval cross-section, edges of the first portion lying on a long axis of its oval cross-section may approach each other in a curved path over the length of the first section. Edges of the first portion lying on a short axis of its oval cross section may approach each other in a substantially straight path over the length of the first section.

The second portion may have a substantially circular cross-section over all or substantially all of its length.

All opposed edges of the second portion may taper towards each other with a maximum average angle of 3 degrees between the opposed edges over the length of the second portion.

The length of the second portion may be at least one quarter of, or one half of, the length of the first portion. The length of the second portion may be no greater than the length of, or twice the length of, the first portion.

The bristles may all be spaced apart from one another. This reduces the risk of hair binding to the brush.

According to another aspect of the invention there is provided a hair brush comprising an array of bristles, at least some or all of the bristles having a transverse cross-section with an elongate shape over some or substantially all of their length and arranged in two or more spaced apart, offset, rows wherein centre lines of the rows are spaced apart such that at least part of the first portion of bristles in one row extends between adjacent bristles in an adjacent row; and/or, when viewed perpendicular to the rows, the width of the bristles in one row is, over part of their length, the same or greater than the space between adjacent bristles in an adjacent row so as to partially occlude the space between bristles in an adjacent row.

The elongate shape may be substantially oval. Over all or part of the array the bristles may be of substantially the same shape.

The follow are optional features of both aspects of the invention.

Bases of adjacent bristles in each row may be spaced apart by a distance which is less than half the maximum width of the base of the bristles.

In one embodiment the bristles are spaced apart by a maximum of 2.5 mm

The bases of bristles in one row may be spaced from the base of the nearest bristle in an adjacent row by a distance which is less than the space between adjacent bristles in the row.

In one embodiment the bases of bristles in one row are spaced from the base of the nearest bristle in an adjacent row by a maximum of 2 mm.

The width and shape of bristles in one row may be such that it only partially occludes the space between bristles in the adjacent row.

Each row of bristles may be substantially straight, or may be curved. The rows may be generally parallel. The bristles in each row, or at least a number of adjacent rows, may all be evenly spaced apart by substantially the same distance.

Adjacent rows may be offset relative to each other so that the centre of each bristle in a row is substantially aligned with the midpoint between bristles in an adjacent row.

The bristles may be tapered, with their cross-section reducing from the base to the free end. With this arrangement the amount of space between bristles reduces towards their base. Therefore the more hair moves into the bristles the more it is gripped by the bristles, owing to the reduced space and a more complex path between bristles, enabling greater tension to be applied to the hair.

The degree of taper of the bristles may change abruptly at the interface between the first and second portions of the bristles There may be at least three or four rows of bristles.

Bristles with a substantially oval cross-section may form an elongate rectangular array of bristles formed from generally parallel long rows and generally parallel short rows of bristles. In this arrangement a long axis of the oval cross-section of each bristle may be substantially aligned with the direction of the long row of which it forms a part.

The bristles may be moulded and may be moulded from a plastics material, particularly a resiliently flexible plastics material.

DETAILED DESCRIPTION OF THE INVENTION

In order that the invention may be more clearly understood embodiments thereof will now be described, by way of example only, with reference to the accompanying drawings, of which:

Figure 1:
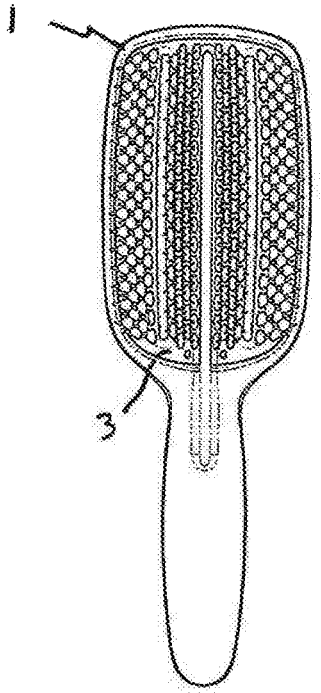
FIG. 1 is a plan view of a hair brush.
Figure 2:
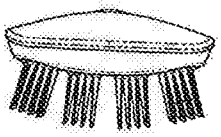
FIG. 2 is an end view the hair brush of FIG. 1.
Figure 3:
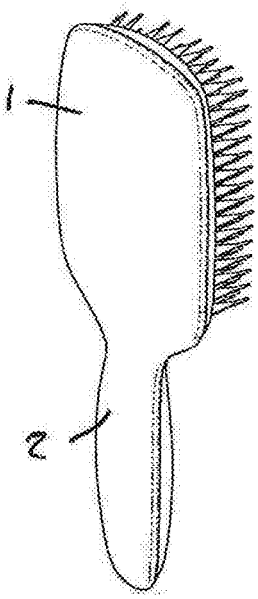
FIG. 3 is a perspective view of the hair brush of FIG. 1 from its underside.
Figure 4:
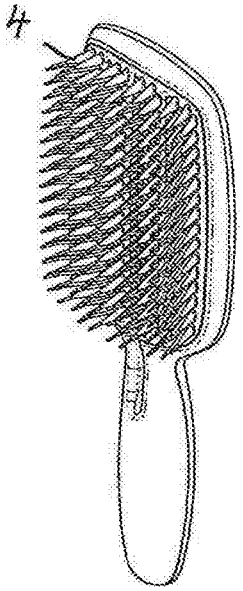
FIG. 4 is a perspective view of the hair brush of FIG. 1 from above.
Figure 5:
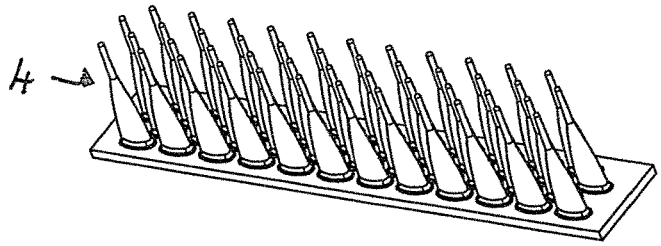
FIG. 5 is a perspective view of part of an array of bristles of the hair bush of FIG. 1.
Figure 6:
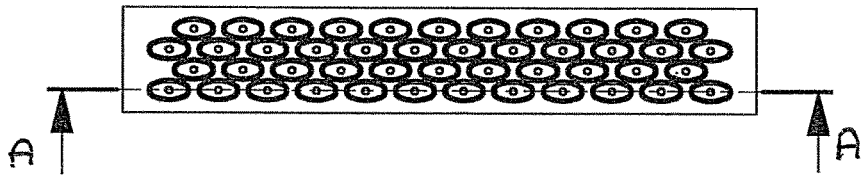
FIG. 6 is a plan view of the array of bristles of FIG. 5.
Figure 8:
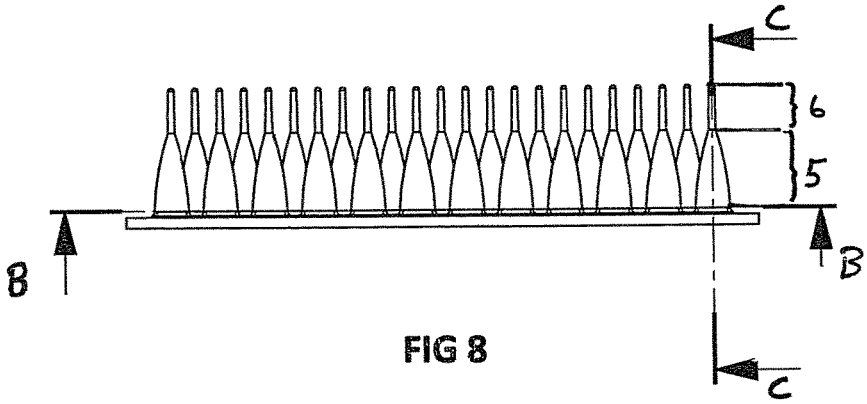
FIG. 8 is a side elevation of the array of bristles of FIG. 5.
Figure 7:
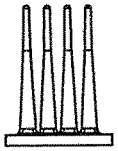
FIG. 7 is an end elevation of the array of bristles of FIG. 5.

In the following the terms front, back, top, bottom and like terms refer to the articles in the orientation in which they are illustrated, but should not be taken as otherwise limiting.

Referring to the drawings, FIGS. 1 to 4 show a hair brush. The hair brush is of a paddle type. It comprises a body 1 of generally rectangular outline moulded in one piece with an elongate handle 2 which extends generally perpendicularly from the approximate mid-point of one of the ends of the body, formed by one of the shorter sides of the rectangle. The body and handle extend in generally the same plane. The underside of the body has a generally convex surface which blends into the handle. The opposite, upper, side of the body defines a cavity into which an insert 3 is fitted.

The exposed surface of the insert, to the upper side of the brush, has a generally convex, part cylindrical, surface. The insert comprises, or supports, moulded bristles 4 which project generally perpendicularly from the exposed surface of the insert 3.

Each bristle 4 is substantially identical to each other bristle. All of the bristles are moulded together in one piece, together with a base (which may form all or part of the insert 3) from a resiliently flexible plastics material. Suitable materials are thermoplastic elastomers, such as copolyesters and aliphatic polyamides (nylons) and, in particular, the copolyester sold under the trade mark Hytrel by E. I. du Pont de Nemours and Company. Grades of Hytrel with hardness from 45 to 82 Shore D are particularly suitable.

Each bristle 4 has a base with a generally oval cross-section, having a long axis and a perpendicular short axis. As the bristle extends away from the base it tapers. Over a first portion 5 of the length of the bristle the bristle tapers such that its cross-sectional shape changes from oval to substantially circular.

Figure 9:
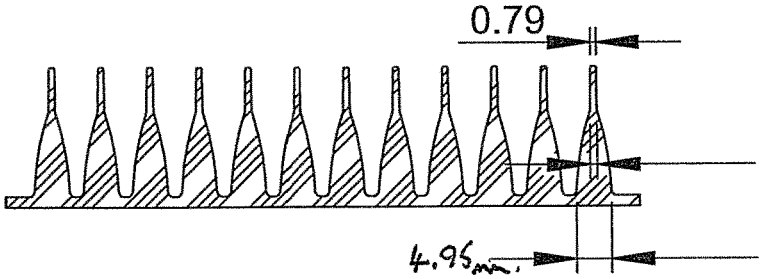
FIG. 9 is a cross-section taken along the line A-A of FIG. 6.
Figure 10:
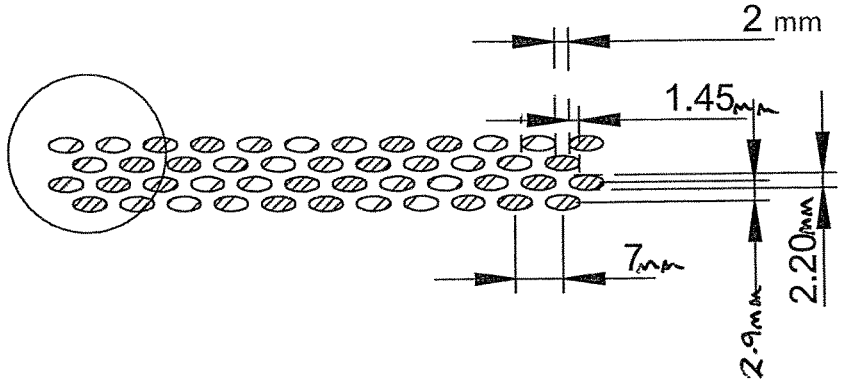
FIG. 10 is a perspective view of a cross-section taken along line B-B of FIG. 8.
Figure 11:
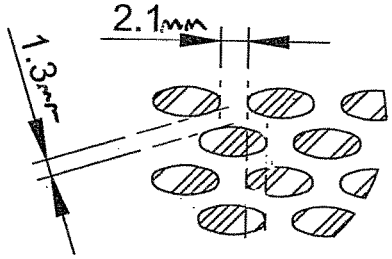
FIG. 11 is an enlargement of the circled area of FIG. 10.

FIG. 9 shows a cross-section through bristles 4 taken along the long axis of the oval cross-section of the bristles. As can be seen from this view, the edges of the bristle through which the long axis extends approach each other at an increasingly steep angle as the bristle extends away from the base. The opposite edges approach each other in a curved path.

Figure 12:
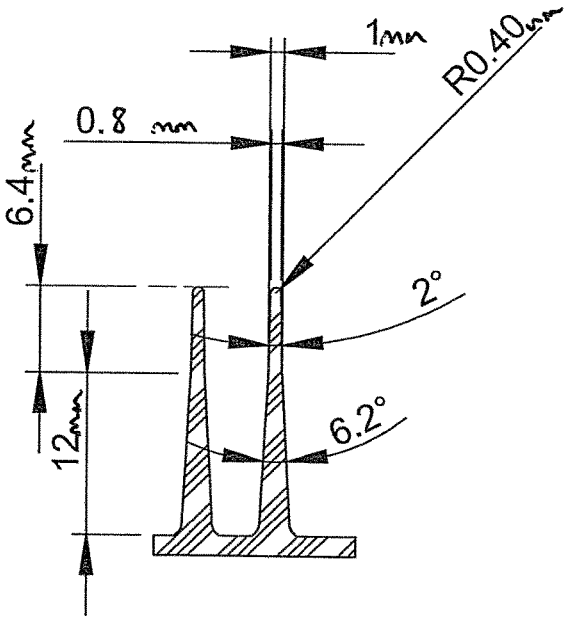
FIG. 12 is an enlarged cross-section of taken along the line C-C of FIG. 8.
Figure 13:
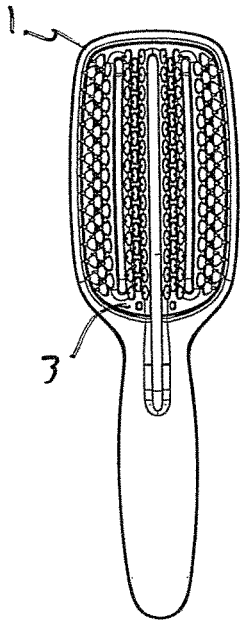
FIG. 13 is a plan view of another hair brush.
Figure 14:
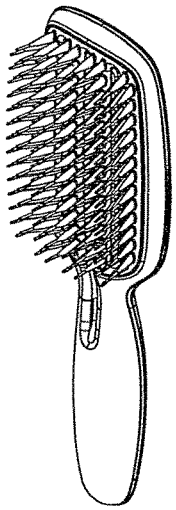
FIG. 14 is a perspective view of the hair brush of FIG. 13 from above.
Figure 15:
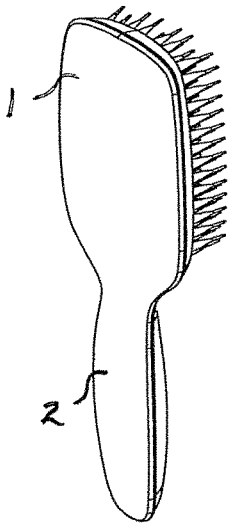
FIG. 15 is a perspective view of the hair brush of FIG. 13 from below.
Figure 16:
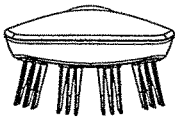
FIG. 16 is an end view the hair brush of FIG. 13.

FIG. 12 shows a cross-section through bristles 4 taken along the short axis of the oval cross-section of the bristles. The edges of the bristle through which the long axis extends approach each other at a substantially constant angle, and the edges of the bristle are therefore substantially straight.

At the end of the first portion of the bristle its cross-section is substantially circular. At this point a second portion of the bristle begins. Over the second portion of the bristle the cross-section of the bristle remains substantially circular and the bristle tapers towards a free end, with a domed surface. The degree of taper of the bristle over the second portion of the bristle is significantly less than over the first portion, and in particular compared to the degree of taper in the first portion immediately adjacent to the second portion. There is therefore a discontinuity in the shape of the surface of the bristle at the junction between the first and second portions.

The degree of taper of the second portion of the bristle is in effect the minimum consistent with being able to reliably remove the bristle from a mould tool. So far as the function of the second portion of the bristle is concerned it could have a substantially constant diameter.

In the illustrated embodiment the first portion 5 of the bristle extends about 12.0 mm from the base, and the second portion 6 of the bristle extends about a further 6.4 mm from the end of the first portion to the end of the bristle. The domed end of the bristle has a radius of curvature of about 0.4 mm.

The widest part of the first portion of the bristle, measured at its base, along the long axis of its oval cross-section, has a width of about 4.95 mm. The narrowest part of the base of the bristle, measured along the short axis of its oval cross-section, has a depth of about 2.2 mm. The sides of the bristle along its short axis approach each other at an angle of about 6.2 degrees. The sides of the bristle along its long axis approach each other with a gradually increasing angle, forming a smooth curve. The average angle of taper between the two sides of the bristle is approximately 19 degrees, that is to say the angle of taper that would be required if the sides were straight rather than tapered.

At the end of the first part of the bristle it has a substantially circular cross-section with a diameter of about 1 mm.

The sides of the bristle approach each other over the second portion of its length with an angle of about 2 degrees, resulting in a diameter of about 0.8 mm at the free end of the bristle, not including the domed end.

Other dimensions are possible, as discussed elsewhere. In particular, the bristle could be sized so that the second portion of the bristle tapers to a diameter of about 1.2 mm.

Each array is generally rectangular in shape, and is intended to be moved through hair in a direction generally perpendicular to the long sides of the rectangle.

Each bristle in the array forms a part of a long row of bristles and a short row of bristles which extends transversely to the long row.

Each of the long rows are very slightly curved (but could be substantially straight), substantially parallel and substantially evenly spaced apart. In each long row the bristles are substantially evenly spaced apart, with the long axes of the oval cross-section of the first part of the bristles all lying substantially along the same straight line. The bristles are spaced apart by the same amount in each long row and adjacent long rows are off-set relative to one another so that the centre of the cross-section of the bristles in one row lies mid-way between adjacent bristles in the adjacent row.

Each of the short rows are substantially straight and substantially parallel. In each short row the bristles are substantially evenly spaced apart, with the short axes of the oval cross-section of the first part of the bristles lying along substantially the same line. The bristles are spaced apart by the same amount in each short row and the centre-lines of each short row are spaced apart so that the base of each bristle in each short row partially extends between two adjacent bristles in the or each adjacent short row In the illustrated embodiment each array comprises four long rows, two rows having 16 bristles and the other two having 15 bristles making 32 short rows. Of course, the number of rows and number of bristles in each row can be varied as desired and appropriate. A substantially square array is possible.

In the illustrated embodiment the bristles in each long row are spaced apart by about 2.1 mm, and the centrelines of adjacent long rows are spaced apart by about 2.9 mm. This results in the smallest gap between a bristle in one row and a bristle in an adjacent row being about 1.3 mm. Other dimensions are possible, as discussed elsewhere.

Although the bristles are moulded in a single piece from the same material, owing to their different cross-section and shape, the first portions are significantly stiffer than the second. In practice, in use, the first portions are effectively substantially rigid, whereas the second portions are resiliently flexible. In practice, in an alternative embodiment the second portions could also be rigid or at least relatively stiff, although having a resiliently flexible second portion is preferred.

The bases of the first portions of the bristles occupy a significant portion (greater than 50%) of the surface area over which the array extends, whereas the second portions of the bristles occupy significantly less than 50% of the available surface area.

Because the width of the base of the first portions of the bristles, along the length of a long row of bristles, is greater than the space between adjacent bristles in the row each bristle occludes the gap between the base of adjacent bristles in adjacent rows when viewed in a direction perpendicular to that of the long rows of bristles. Owing to the shape of the first portion of the bristles the gap between adjacent bristles is occluded over a little over half the length of that portion of the bristles over the base.

FIGS. 13 to 16 show an alternative hair brush. This hair brush is substantially the same as that shown in FIGS. 1 to 4, and parts of the brush are denoted with the same reference numerals, except that each of the generally rectangular arrays of bristles comprise three substantially parallel long rows of bristles. The two arrays at the respective outside edges of the brush consist of long rows of 13, 14 and 13 bristles thus forming 14 short rows of two bristles alternating with 13 single bristles. The two arrays positioned side by side in between the two outer arrays consist of long rows of 14, 13 and 14 bristles.

Figure 17:
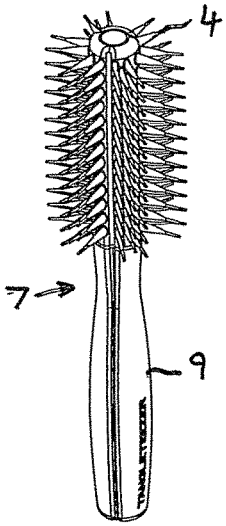
FIG. 17 is a perspective view of another hair brush from above.
Figure 18:
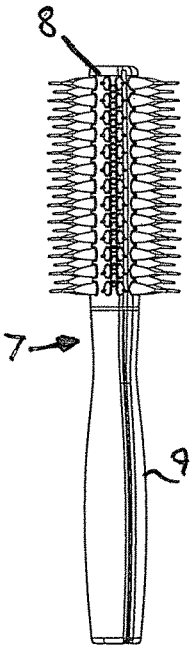
FIG. 18 is a plan view of the hair brush of FIG. 17.
Figure 19:
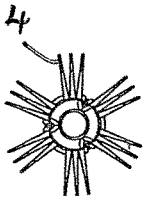
FIG. 19 is an end view of the hair brush of FIG. 17.

FIGS. 17 to 19 show another hair brush, in this case a so-called round brush. The brush comprises an elongate body 7. One end 8 of the body is substantially cylindrical, and the other end 9 is shaped to form a comfortable handle. The cylindrical end 8 of the body supports six generally rectangular arrays of radially extending bristles 4. Each array of bristles comprises three parallel long rows of 13, 12 and 13 bristles of the type shown in FIGS. 5 to 12. The rows of bristles extend parallel to the long axis of the cylindrical part 8 of the body and are evenly spaced around the circumference of the body, the space between each array being greater than the space between individual rows in each array.

Figure 20:
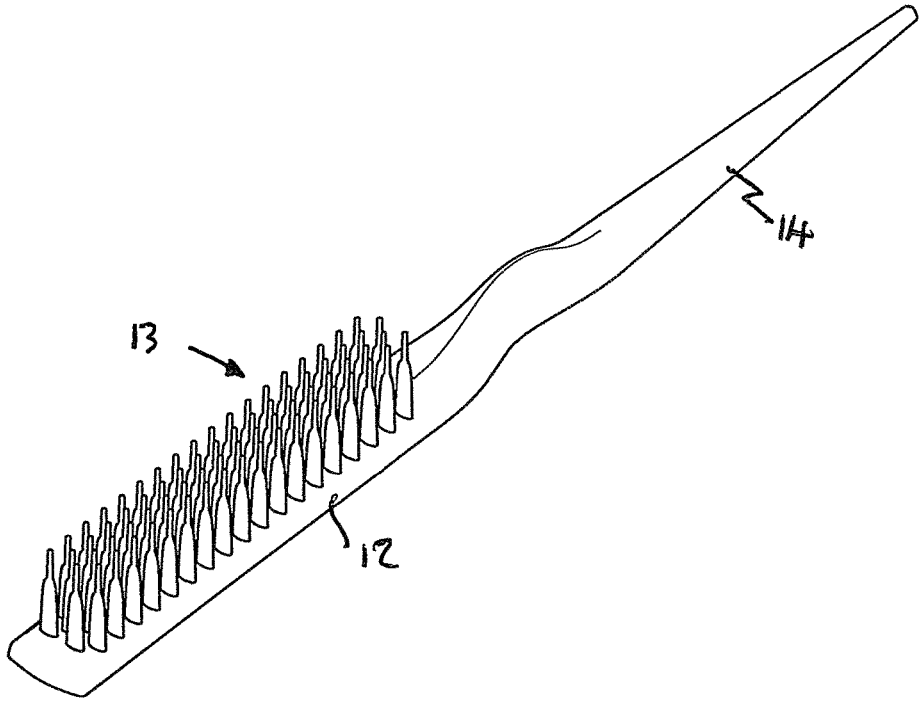
FIG. 20 is a perspective view of another hair brush.

FIG. 20 shows yet another hair brush. This brush comprises an elongate body 11. At one end the body provides an elongate generally rectangular paddle 12 which supports a generally rectangular array of bristles 13 which are illustrated in greater detail in FIGS. 23 to 26. The array of bristles is intended in use to be moved through hair in a direction generally perpendicular to the long sides of the rectangle At the opposite end the body is shaped to form a comfortable handle 14.

Each individual bristle in the array 13 is substantially identical to each other bristle. All of the bristles are moulded together in one piece, together with a base 15 from a resiliently flexible plastics material. Suitable materials are those discussed above in relation to the bristles illustrated in FIGS. 5 to 12.

Each bristle has a base with a generally oval cross-section, having a long axis and a perpendicular short axis. As the bristle extends away from the base 15 it tapers. Over a first portion 16 of the length of the bristle the bristle tapers such that its cross-sectional shape changes from oval to substantially circular.

Figure 21:
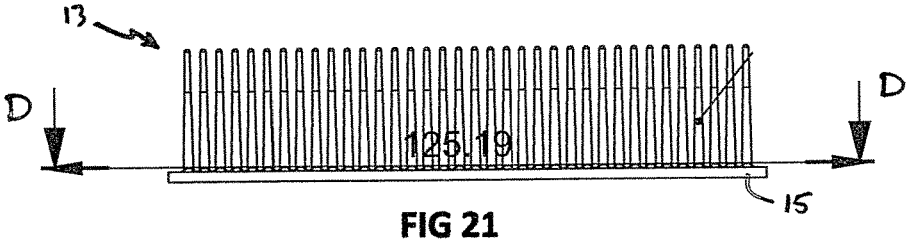
FIG. 21 is a side elevation of the array of bristles of the hair brush of FIG. 20.

FIG. 21 shows a cross-section through bristles taken along the short axis of the oval cross-section of the bristles. The edges of the bristle through which the long axis extends approach each other at a substantially constant angle, and the edges of the bristle are therefore substantially straight.

Figure 22:
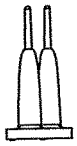
FIG. 22 is an end elevation of the array of bristles of FIG. 21.
Figure 23:
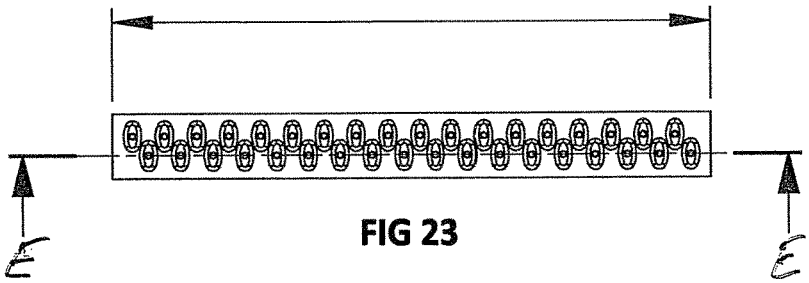
FIG. 23 is a plan view of the array of bristles of FIG. 21.
Figure 24:
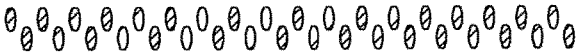
FIG. 24 is cross-section taken along the line D-D of FIG. 21.
Figure 25:
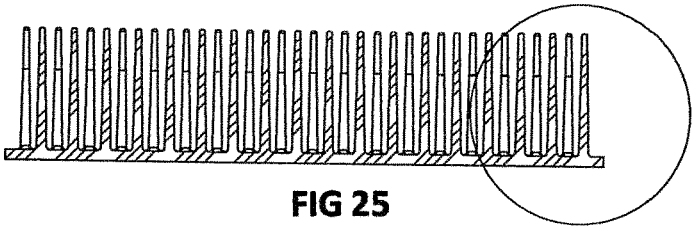
FIG. 25 is a cross-section taken along the line E-E of FIG. 23.
Figure 26:
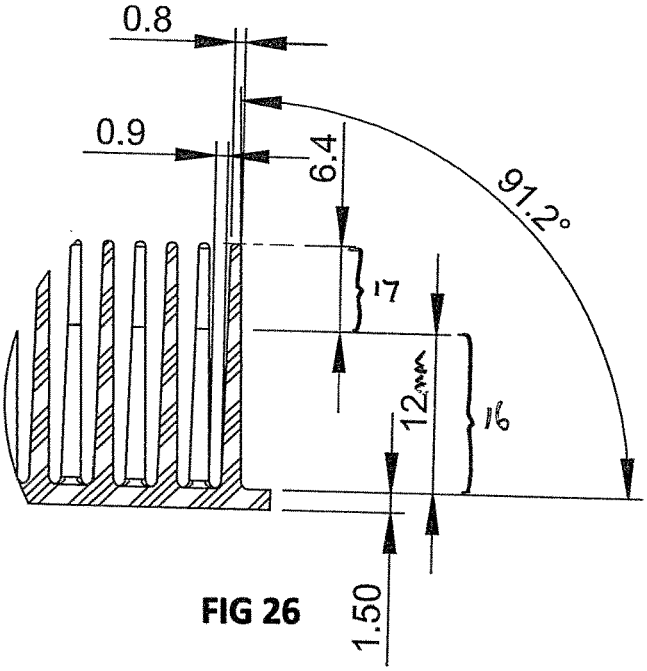
FIG. 26 is an enlarged view of the circled area of FIG. 25.

FIG. 22 shows a cross-section through bristles taken along the long axis of the oval cross-section of the bristles. As can be seen from this view, the edges of the bristle through which the long axis extends approach each other at an increasingly steep angle as the bristle extends away from the base. The opposite edges are approach each other in a curved path.

At the end of the first portion 16 of the bristle its cross-section is substantially circular. At this point a second portion 17 of the bristle begins. Over the second portion of the bristle the cross-section of the bristle remains substantially circular and the bristle tapers towards a free end, with a domed surface. The overall degree of taper of the bristle over the second portion of the bristle is significantly less than over the first portion, and in particular compared to the degree of taper in the first portion immediately adjacent to the second portion. There is therefore a discontinuity in the shape of the surface of the bristle at the junction between the first and second portions.

The degree of taper of the second portion of the bristle is in effect the minimum consistent with being able to reliably remove the bristle from a mould tool. So far as the function of the second portion of the bristle is concerned it could have a substantially constant diameter.

In the illustrated embodiment the first portion 16 of the bristle extends about 12.0 mm from the base, and the second portion 17 of the bristle extends about a further 6.4 mm from the end of the first portion to the end of the bristle. The domed end of the bristle has a radius of curvature of about 0.4 mm.

The widest part of the first portion of the bristle, measured at its base, along the long axis of its oval cross-section, has a width of about 3.5 mm. The narrowest part of the base of the bristle, measured along the short axis of its oval cross-section has a depth of about 1.5 mm. The sides of the bristle along its short axis approach each other at an angle of about 2.4 degrees. The sides of the bristle along its long axis approach each other with a gradually increasing angle, forming a smooth curve of gradually decreasing radius. The initial angle of taper between the two sides of the bristle at its base is approximately 3.1 degrees.

At the end of the first part of the bristle it has a substantially circular cross-section with a diameter of about 1 mm.

The sides of the bristle approach each other over the second section of its length with an angle of about 2 degrees, resulting in a diameter of about 0.8 mm at the free end of the bristle, not including the domed end.

Other dimensions are possible, as discussed elsewhere.

In the array, the bristles are arranged into two substantially straight, substantially parallel long rows. In each row the bristles are substantially evenly spaced apart, with the short axes of the oval cross-section of the first part of the bristles all lying substantially along the same straight line. The bristles are spaced apart by the same amount in each row and adjacent rows are off-set relative to one another so that centre of the cross-section of the bristles in one row lies mid-way between adjacent bristles in the adjacent row. In the illustrated embodiment each row has 18 bristles. Of course, the number of rows and the number of bristles in each row can be varied as desired and appropriate. Embodiments are possible with 3, 4 or more rows.

In the illustrated embodiment the bristles in each row are evenly spaced apart, with the centres of each bristle being spaced apart by about 2.4 mm, and the centrelines of adjacent rows are spaced apart by about 2.9 mm. As a consequence, as viewed in a direction parallel to the rows of bristles, the two rows overlap each other at the base of the bristles, the base of the bristles in one row partially extending between two adjacent bristles in an adjacent row. Owing to the shape of the first portion of the bristles the gap between adjacent bristles is occluded over a little over half the length of that portion of the bristles over the base, as best seen in FIG. 22. When viewed in a direction perpendicular to the rows of bristles there is a gap between adjacent bristles over the entire length of the bristles. This gap has a minimum width of 0.9 mm at the base of the bristles.

Other dimensions are possible, as discussed elsewhere.

Although the bristles are moulded in a single piece from the same material, owing to their different cross-section and shape, the first portions are significantly stiffer than the second. In practice, in use, the first portions are effectively substantially rigid, whereas the second portions are resiliently flexible.

The bases of the first portions of the bristles occupy a significant portion (greater than 50%) of the surface area over which the array extends, whereas the second portions of the bristles occupy significantly less than 50% of the available surface area.

The paddle and round brushes illustrated in FIGS. 1 to 19 are particularly suited to styling hair when blow drying, because they enable tension to be applied to hair. When hair is brushed, it first meets the relatively thin, flexible, second portions of the bristles. These portions easily penetrate and divide the hair between the bristles. And, owing to their flexibility, they help to remove any tangles from the hair. As the brush is urged against the hair the hair is drawn into the bristles and moves into the increasingly narrow spaces between the relatively stiff first portions of the bristles. The offset relationship of the long rows of bristles, which in use are drawn across hair in a direction generally perpendicular to the direction of the long rows, with no 'line of sight' over much of the height of the first portion of the bristles over the base, causes the hair to be forced into a complex path, weaving between bristles. Making the hair travel through this path, as well as forcing the hair into the increasingly narrow space between the bristles as the brush is urged against the hair, increases friction between the brush and the hair enabling tension to be applied to the hair without the need to wrap the hair around the brush several times. At the end of as brush stroke, the brush can be easily removed from the hair. Once pressure of the brush onto hair is released, the shape of the first portion of the bristles allows the hair to move easily off the bristles, into regions where there is more space between the bristles. This reduces the risk of hair binding onto the brush.

The brush illustrated in FIGS. 20 to 26 is particularly suited for back combing hair. As with the other embodiments the relatively thin, flexible, second portions of the bristles easily penetrate and divide the hair between the bristles. This enables hair to be captured in the relatively narrow spaces between the first portion of the bristles. The narrow spaces increase friction between the hair and the brush, enabling the brush to effectively grab and tease hair, as required by the back combing technique. When sufficient body has been generated this way, the second portions of the bristles can be used to smooth the outer layer of hair to provide a neat finish. Not only is the brush more effective in teasing hair to build body, but it allows the subsequent smoothing step to be performed with the same brush, avoiding the need to use two different brushes or combs.

The above embodiments are described by way of example only. Many variations are possible without departing from the scope of the invention as defined in the appended claims.

The invention claimed is:

1. A device for styling hair, the device comprising:

a solid flat top surface, from which an array of bristles independently extend, each from a base to a free end;

at least some or all of the bristles comprising a first-portion which tapers from the base and a second portion which extends from the first portion to the free end, wherein the first portion is wider relative to the second portion, and has a non-circular transverse cross-section at its base which gradually transitions to a circular cross section at which it meets the second portion, the bristles being arranged in two or more spaced apart, offset, rows; further wherein at least one of:

a) in at least half of the rows, centre lines of the rows are spaced apart such that at least part of the first portion of bristles in one row extends between adjacent bristles in an adjacent row, the bristles are sized and arranged so that, in use, the second portion serves to penetrate and divide hair between the bristles and the first portion of the bristles enables tension to be applied to the hair when hair flows between the bristles; and b) when viewed perpendicular to the rows, in at least half of the rows, the width of the first portion of the bristles in one row is, over part of their length, the same or greater than the space between adjacent bristles in an adjacent row so as to partially occlude the space between bristles in an adjacent row, the bristles are sized and arranged so that, in use, the second portion serves to penetrate and divide hair between the bristles and the first portion of the bristles enables tension to be applied to the hair when hair flows between the bristles.

2. The device as claimed in claim 1 wherein, when viewed in the same direction, the width of the widest part of the first portion of the bristles comprising first and second portions is at least three times, the width of the bristle in the second portion at or near to its free end.

3. The device as claimed in claim 1 wherein the length of the bristles having first and second portions is no greater than seven times its maximum width.

4. The device as claimed in claim 1 wherein two opposed edges of the first portion of those bristles having first and second portions taper towards each other with a minimum average angle of at least 15 degrees between the opposed edges over the length of the first portion, and opposite edges of the second portion taper towards each other with a maximum average angle of 5 degrees between opposed edges over the length of the second portion.

5. The device-as claimed in claim 4 wherein the angle between the opposed edges of the first portion increases from the base of the bristle to the end of the first portion and the opposed edges of the first portion are curved.

6. The device as claimed in claim 1 wherein the transverse cross sectional shape of the first portion of the bristles is non-circular over at least part of its length, and wherein bristles with the non-circular transverse cross sectional shape form an elongate array of bristles formed of long rows and short rows, wherein a long axis of the non-circular cross section of the bristles is aligned with the direction of the long row of which it forms a part.

7. The device as claimed in claim 6 wherein the first portion of the bristles has an oval transverse cross-section over at least part of its length.

8. The device as claimed in claim 7 wherein edges of the first portion lying on the long axis of the oval cross-section of the bristle approach each other in a curved path over the length of the first portion from the base of the first portion to an end of the first portion and edges of the first portion lying on a short axis of the oval cross-section of the bristle approach each other in a straight path over the length of the first portion from the base of the first portion to the end of the first portion.

9. The device as claimed in claim 1 wherein the length of the second portion is no greater than the length of, or twice the length of, the first portion.

10. The hair-styling device of claim 1 comprising a paddle brush.

11. The device of claim 1 comprising a round brush.

12. A hair-styling device comprising:

(a) a solid top surface from which an array of bristles extend, wherein each bristle is independent, and extends from a base to a free end, at least some or all of the bristles having a transverse cross-section with a non-circular shape over some or all of their length and being arranged in two or more spaced apart, offset, rows of bristles having the transverse cross-section with the non-circular shape over some or all of their length wherein at least one of:

(i) centre lines of at least half of the rows of bristles having the transverse cross-section with the non-circular shape over some or all of their length are spaced apart such that at least part of the bristles having the transverse cross-section with the non-circular shape over some or all of their length in one row extends between adjacent bristles having the transverse cross-section with the non-circular shape over some or all of their length in an adjacent row so as to at least partially occlude the space between the adjacent bristles in the adjacent row; and (ii) when viewed perpendicular to the rows, for at least half of the rows the width of the bristles having the transverse cross-section with the non-circular shape over some or all of their length in one row is, over part of their length, the same or greater than the space between adjacent bristles having the transverse cross-section with the non-circular shape over some or all of their length in an adjacent row so as to partially occlude the space between bristles having the transverse cross- section with the non-circular shape over some or all of their length in an adjacent row;

(b) wherein bristles with a non-circular cross-section form an elongate array of bristles formed from generally parallel long rows and generally parallel short rows of bristles wherein a long axis of the non-circular cross-section of each bristle is aligned with the direction of the long row of which it forms a part.

13. The hair-styling device as claimed in claim 12 wherein the non-circular shape of the transverse cross-section of the bristles is oval.

14. The hair-styling device as claimed in claim 12 wherein the bases of adjacent bristles having the transverse cross-section with the non-circular shape over some or all of their length in each row are spaced apart by a distance which is less than half the maximum width of the base of the bristles having the transverse cross-section with the non-circular shape over some or all of their length.

15. The hair-styling device of claim 12 comprising a paddle brush or a round brush.

16. The hair-styling device of claim 12 comprising wherein the centre lines of the rows of bristles having the transverse cross-section with the non-circular shape over some or all of their length are spaced apart such that at least part of the bristles having the transverse cross-section with the non-circular shape over some or all of their length in one row extends between adjacent bristles having the transverse cross-section with the non-circular shape over some or all of their length in the adjacent row; and when viewed perpendicular to the rows, the width of the bristles in one row is, over part of their length, the same or greater than the space between adjacent bristles in the adjacent row so as to partially occlude the space between bristles having the transverse cross-section with the non-circular shape over some or all of their length in the adjacent row.

17. A hair-styling device of claim 12, the long row comprising more bristles than the short row.

18. A hair-styling device comprising:

an array of bristles, wherein each bristle is independent, at least some or all of the bristles having a transverse cross-section with an oval shape over some or all of their length and at least some or all of the bristles arranged in two or more spaced apart, offset, rows wherein at least one of:

a) centre lines of at least half of the rows are spaced apart such that at least part of the bristles in one row extends between adjacent bristles in an adjacent row so as to at least partially occlude the space between the adjacent bristles in the adjacent row; and b) when viewed perpendicular to the rows, for at least half of the rows the width of the bristles in one row is, over part of their length, the same or greater than the space between the adjacent bristles in the adjacent row so as to partially occlude the space between bristles in the adjacent row;

wherein the bristles with an oval shape form an elongate array of bristles formed from generally parallel long rows and generally parallel short rows of bristles; and wherein a long axis of the oval cross-section of at least some or all of the bristles with an oval shape over some or all of their length is aligned with the direction of the long row of which it forms a part.

19. The hair-styling device according to claim 18 wherein the long axis of the oval cross-section of each bristle is aligned with the direction of the long row of which it forms the part.

20. The hair-styling device of claim 18 comprising a paddle brush or a round brush.

* * * * *